US005385009A

United States Patent [19]

Schuller

[11] Patent Number: 5,385,009

[45] Date of Patent: Jan. 31, 1995

[54] PROCESS FOR PIECING AND CLEANING IN AN OPEN-END SPINNING DEVICE

[75] Inventor: Edmund Schuller, Ingolstadt, Germany

[73] Assignee: Rieter Ingolstadt Spinnereimaschinenbau AG, Ingolstadt, Germany

[21] Appl. No.: 102,734

[22] Filed: Aug. 6, 1993

[30] Foreign Application Priority Data

Aug. 7, 1992 [DE] Germany ..... 4226195

[51] Int. Cl.[6] ..... D01H 13/26

[52] U.S. Cl. ..... 57/263; 57/264; 57/302

[58] Field of Search ..... 57/301, 302, 264, 263

[56] References Cited

U.S. PATENT DOCUMENTS

| | | | |
|---|---|---|---|
| 3,810,352 | 5/1974 | Miyazaki et al. . | |
| 3,879,926 | 4/1975 | Bartling et al. . | |
| 4,047,371 | 9/1977 | Stahlecker | 57/264 X |
| 4,159,620 | 7/1979 | La Flaquiere et al. | 57/301 |
| 4,192,129 | 3/1980 | Stahlecker | 57/301 |
| 4,265,083 | 5/1981 | Braun et al. . | |
| 4,644,742 | 2/1987 | Lovas et al. . | |
| 4,763,467 | 8/1988 | Nickolay et al. . | |
| 4,821,502 | 4/1989 | Bursek et al. | 57/263 |
| 4,893,462 | 1/1990 | Braun et al. . | |
| 5,235,800 | 8/1993 | Slavik et al. | 57/264 |

FOREIGN PATENT DOCUMENTS

| | | |
|---|---|---|
| 0467159A1 | 1/1992 | European Pat. Off. . |
| 2008142 | 9/1970 | Germany . |
| 2238610 | 2/1974 | Germany . |
| 2502426 | 7/1976 | Germany . |
| 3202428A1 | 8/1983 | Germany . |
| 3536913A1 | 4/1987 | Germany . |
| 3726531C1 | 12/1988 | Germany . |
| 3937729A1 | 8/1990 | Germany . |
| 4039486A1 | 6/1992 | Germany . |
| 2017168 | 10/1979 | United Kingdom . |

*Primary Examiner*—Daniel P. Stodola
*Assistant Examiner*—William Stryjewski
*Attorney, Agent, or Firm*—Dority & Manning

[57] ABSTRACT

A process for responding to a malfunction at an open-end spinning station of an open-end spinning machine which requires piecing of the yarn at the spinning station. The process is for use in open-end spinning machines having a travelling service unit which travels alongside adjacently dispose spinning stations for servicing the spinning stations. The process includes summoning the traveling service unit to the malfunctioning spinning station and attempting piecing at the spinning station with the service unit for at least 2 attempts. Before each of the piecing attempts, the spinning rotor of the station is cleaned of fiber and debris before each of the piecing attempts. If the piecing attempts are unsuccessful, the present method calls for cleaning the spinning rotor a final time after the last unsuccessful piecing attempt so that any debris or fiber left in the rotor from the unsuccessful piecing attempt is removed thereby preventing damage to the spinning rotor or bearings caused by an imbalance in the rotor.

6 Claims, 1 Drawing Sheet

PROCESS FOR PIECING AND CLEANING IN AN OPEN-END SPINNING DEVICE

BACKGROUND OF THE INVENTION

The instant application relates to a process for the operation of an open-end spinning device.

It is known from the state of the art that open-end rotor spinning machines are equipped with a travelling service unit which is able to eliminate malfunctions at spinning stations autonomously. Such a device is described in DE 32 02 428 A1, for example. The service unit becomes active, for example to exchange fully wound bobbins against empty tubes. However, the utilization of the service unit to eliminate malfunctions in yarn production is its special area of application. A service unit patrolling alongside the spinning stations of the rotor spinning machine which communicates with a machine center as it passes the spinning stations and is informed on the state of the spinning station by the machine center is known through the RU 14 open-end spinning machine of Schubert & Salzer Maschinenfabrik Aktiengesellschaft, now Rieter Ingolstadt Spinnereimaschinenbau AG 85046 Ingolstadt/Germany. When the service unit arrives at a spinning station having a malfunction, caused for example by yarn breakage, the service unit becomes automatically active and starts to set the yarn production at the spinning station in motion again. Aside from stoppages which cannot be corrected by the service unit, yarn breakage is the most important source of malfunction. It is caused through dirt in the rotor for instance, so that the continuous yarn production can no longer be maintained, resulting in the breaking of the yarn and stoppage of the spinning station. In the known rotor spinning machines, a stopping of the spinning station does however not mean that the spinning rotor is stopped, but only that the fiber feed to the spinning rotor is interrupted. The spinning rotor remains in its mounting and is driven by its tangential drive belt, thus ensuring constant conditions for the drive belt and for the adjoining spinning stations. If the service unit has reached a spinning station where yarn production is to be set again in motion, it assumes its position at this spinning station and attempts to set yarn production in motion again.

The individual steps of piecing are sufficiently known from the state of the art and shall be indicated only briefly here. The start-up of the spinning station begins, for example in the above-mentioned RU 14, with the search for the yarn end which is located on the partially wound bobbin. When the yarn end has been found it is prepared by the service unit and is fed back into the spinning rotor for the piecing of the new fibers to the yarn end. Following the twisting of the new fibers to incorporate them into the yarn, the yarn is withdrawn from the spinning device and is wound on the bobbin. The service unit thereupon transfers the yarn to the rotor spinning machine which takes over the further yarn production. The cleaning of the spinning rotor before the yarn end is fed back into it is an important activity of the service unit during this piecing of the yarn. To clean the rotor, the greatest variety of processes are used, e.g. pneumatic cleaning, cleaning by means of scrapers and cleaning by means of cleaning fluids.

As a rule, yarn production is resumed by the spinning station after the very first piecing attempt. It may however occur that a renewed attempt to restart the spinning station is necessary. In such case the sequence of steps for the piecing of the yarn begin again from the start. As a rule, a maximum of 3 attempts is made. If the spinning station has not been restarted after that, it is placed on malfunction status. This means that the machine center calls off the service unit from the spinning station, or that the service unit leaves the spinning station automatically. At the same time however, provisions are made so that the automatic service unit no longer services this spinning station as it passes it again on its patrol. It is then said that the spinning station has been shut down. However, this does not mean that the rotor of the spinning station is stopped, just as it is not stopped when a yarn breakage is caused by operation, but only means that the conveying of new fibers to the spinning rotor is interrupted. The rotor itself continues to run at operating speed and thereby affects the wear parts of the spinning station, such as the rotor bearing for example.

The known processes have therefore the disadvantage that the spinning station is under particular heavy stress, in particular the rotor bearing in radial and axial direction, because when the spinning station in which the rotor continues to run at operating speed is shut down, fibers or fiber remnants are as a rule present in the yarn-forming groove of the spinning rotor. In the worst case, these fibers or fiber remnants may result in a great imbalance of the rotor. This may lead to different types of damage to the rotor bearing and also to the spinning device. This is because the rotor movement becomes very unsteady and may begin to oscillate in radial direction. These oscillations produce a more or less extreme pressure against the supporting disks which produce an axial thrust, causing the rotor to be subjected axially to a force which will either damage the axial bearing of the rotor or will cause the rotor to be thrown in a counter-reaction from the axial bearing in the direction of the rotor cover.

The higher the rotational speed, the greater will be the effect of imbalance of the rotor, so that an improvement is important, in particular for rotor spinning devices running at high rotational speeds.

OBJECTS AND SUMMARY OF THE INVENTION

It is a principal object of the instant invention to create a process for the operation of an open-end spinning device by means of which the disadvantages of the state of the art may be avoided and unnecessary wear of the wear parts of the spinning station may be avoided. Additional objects and advantages of the invention will be set forth in part in the description which follows, or may be obvious from the description, or may be learned by practice of the invention.

DETAILED DESCRIPTION OF THE PREFERRED EMBODIMENTS

Figure 1:
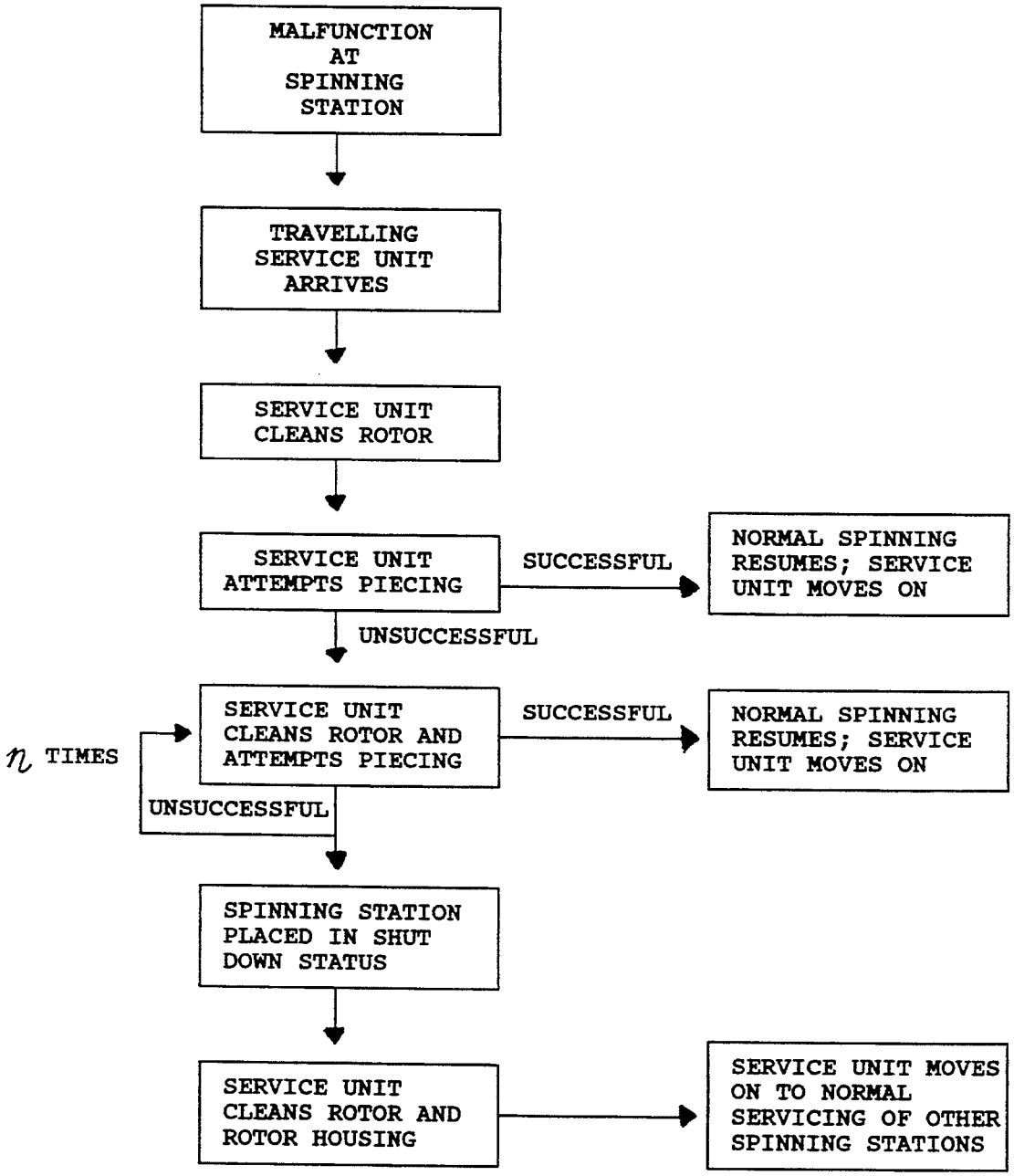
FIG. 1 is a flow chart depicting the present inventive process.

Reference will now be made in detail to the presently preferred embodiment of the invention, an example of which is illustrated in the drawing. The example and description is provided by way of explanation of the invention, not limitation of the invention. In fact, it will be apparent to those skilled in the art that various modifications and variations can be made in the invention without departing from the scope or spirit of the invention.

The process according to the invention makes it possible that the spinning station to be shut down be rendered operational to such an extent that no unnecessary stresses are imposed upon the rotor bearing. Thanks to the especially simple step according to the invention consisting in cleaning the rotor once more after the last unsuccessful attempt to piece the yarn, operating conditions of the affected spinning station are easily improved to a considerable extent. Especially because the spinning stations which are placed in malfunction status generally remain in that state for some time, due to the fact that the maintenance of the spinning station by personnel now takes place at longer intervals, the application of the process of the instant invention has an especially advantageous effect upon the life of the different components of the spinning station.

It is especially advantageous if the rotor housing is also cleaned. This ensures that residue dirt which may remain in the rotor housing after the cleaning of the rotor and may have a disadvantageous influence upon the running of the spinning rotor, is also removed. Especially thorough cleaning can be achieved by opening the rotor housing. If the rotor housing remains open this has the advantage that the maintenance personnel will be able to clearly recognize the condition of the spinning device. It is especially advantageous to stop the rotor in a spinning device of that type after yarn breakage as well as after the unsuccessful piecing attempt. For this purpose it is uncoupled from its drive means so that an imbalance in the rotor may not cause any damage, but remains in the nip of the supporting disk bearing.

It will be apparent to those skilled in the art that various modifications and variations can be made in the present invention. Thus, it is intended that the present invention cover such modifications and variations as come within the scope of the appended claims and their equivalents.

I claim:

1. A process for responding to a malfunction at an open-end spinning station of an open-end spinning machine and for preventing imbalance and excessive wear of a spinning rotor of the spinning station, the open-end spinning machine being configured with a travelling service unit which travels alongside adjacently disposed spinning stations for servicing the spinning stations, said process comprising the steps of:

summoning the travelling service unit to the malfunctioning spinning station;

attempting piecing at the spinning station with the travelling service unit for a predetermined number of piecing attempts, including cleansing the spinning rotor of the spinning station of fiber and debris before each piecing attempt;

if piecing is unsuccessful after said predetermined number of piecing attempts, cleaning the spinning rotor a final time without attempting subsequent piecing so that the spinning rotor is left in a clean condition, designating the spinning station as being in a shut down status, and commanding the travelling service unit to leave the spinning station and to continue its normal servicing of other spinning stations without again attempting piecing and causing fibers to be fed to the cleaned spinning rotor until an operator has corrected whatever malfunction existed at the spinning station, the clean spinning rotor continuing to spin at operational speeds in its shut down status but without fiber and debris within the spinning rotor causing imbalance and excessive wear of the spinning rotor.

2. The process as in claim 1, further comprising cleaning a rotor housing of the spinning station during the final cleaning of the spinning rotor after the predetermined number of piecing attempts.

3. The process as in claim 1, further comprising opening a rotor housing of the spinning station for the final cleaning of the spinning rotor after the predetermined number of piecing attempts.

4. The process as in claim 3, further comprising cleaning the rotor housing after cleaning of the spinning rotor while the rotor housing is opened.

5. The process as in claim 3, further comprising leaving the rotor housing opened after the service unit leaves the spinning station.

6. The process as in claim 1, including making from two to five piecing attempts before the final cleaning of the spinning rotor.

* * * * *